United States Patent [19]

Crouse

[11] 4,297,909

[45] Nov. 3, 1981

[54] TRANSMISSION SHIFT CONTROL LINKAGE FOR CONTROLLING BOTH SPEED AND DIRECTION CHANGES WITH ONE INPUT MOTION

[75] Inventor: Stephen K. Crouse, Dubuque, Iowa

[73] Assignee: Deere & Company, Moline, Ill.

[21] Appl. No.: 103,497

[22] Filed: Dec. 14, 1979

[51] Int. Cl.[3] ..... G05G 9/00

[52] U.S. Cl. ..... 74/473 R; 74/470; 74/475; 74/875; 137/630.19; 192/0.098

[58] Field of Search ..... 74/470, 473 R, 471 R, 74/474, 475, 874, 875; 137/630.19; 192/0.098

[56] References Cited

U.S. PATENT DOCUMENTS

| | | | |
|---|---|---|---|
| 2,396,231 | 3/1946 | Brill | 74/875 X |
| 2,519,080 | 8/1950 | Simpson | 74/874 X |
| 3,666,033 | 5/1972 | Haug | 74/496 X |
| 3,952,512 | 4/1976 | Feller | 74/470 X |

*Primary Examiner*—Allan D. Herrmann

[57] ABSTRACT

A shift control linkage for a hydraulically controlled transmission includes a pivotally mounted input member coupled to a direction (forward, neutral and reverse) control valve spool and a speed (first, second, third, etc.) control valve spool by first and second output links and selectively operable to various positions to the opposite sides of a neutral position to respectively select various forward and reverse drive speeds.

8 Claims, 2 Drawing Figures

N
F
R
1
2
3
70
72
10
32
F
N
R
30
60
3
2
1
40
34
38
26
56
36
12
64
20
16
22
14
66
68
54
18

TRANSMISSION SHIFT CONTROL LINKAGE FOR CONTROLLING BOTH SPEED AND DIRECTION CHANGES WITH ONE INPUT MOTION

BACKGROUND OF THE INVENTION

The present invention relates to controls for effecting direction and speed changes in a hydraulic power shift transmission having multiple forward and reverse speeds and more particularly relates to shift control linkages for effecting direction and speed changes in such transmissions.

Various types of shift control linkages are known in the prior art which include a single lever for effecting direction and speed changes in hydraulic power shift transmissions. Examples of such linkages are disclosed in U.S. Pat. Nos. 3,242,758 granted to Harris et al on Mar. 29, 1966, 3,679,018 granted to Luft on July 25, 1972 and 3,853,019 granted to McAdams on Dec. 10, 1974.

The Harris et al and McAdams patents both show single shift levers which are mounted for pivoting sideways along a first path for selecting different drive directions (neutral, reverse or forward) and for being pivoted along separate paths oriented 90° from the first path for selecting various drive speeds. The structure of these linkages which permit the use of a single shift lever are relatively complex and suffer from the disadvantage of being somewhat difficult to manufacture and assemble.

The Luft patent shows a single shift lever mounted for simply pivoting along a single fore-and-aft path to effect both direction and speed changes and accordingly much of the complexity of the aforementioned Harris et al and McAdams shift linkages is avoided. However, the Luft linkage includes a specially configured cam plate coupled to the shift lever for operating direction and speed selector valves for routing air pressure for operating the transmission shift control valves and consequently the Luft linkage and associated air pressure system still is a rather complex system for effecting shifting of the transmission thereof.

SUMMARY OF THE INVENTION

According to the present invention, there is provided an improved linkage for effecting direction and speed changes in a hydraulic power shift transmission by manipulation of a single shift lever.

An object of the invention is to provide a simple shift control linkage, including a shift lever mounted for swinging along a single path of movement, for effecting both directions and speed changes in a hydraulic power shift transmission.

A more specific object is to provide a shift control linkage according to the previous object wherein the linkage components are simply constructed and mounted.

Yet another object of the invention is to provide a shift control linkage including an input link having first and second legs arranged to define an included angle of 90° and having first and second ends respectively coupled to direction and speed selector valves by first and second output links and being pivotally supported between its ends for movement about a fixed axis, and the first output link being yieldably extensible and retractable to permit various speeds to be selected without there being a change in the direction control valve, and the second output link being connected to the input link such that a line drawn through opposite ends of the second output link intersect the axis of rotation of the input link when the latter is in a centered, neutral position.

These and other objects will become apparent from a reading of the following description together with the appended drawing.

DESCRIPTION OF THE PREFERRED EMBODIMENT

Figure 1:
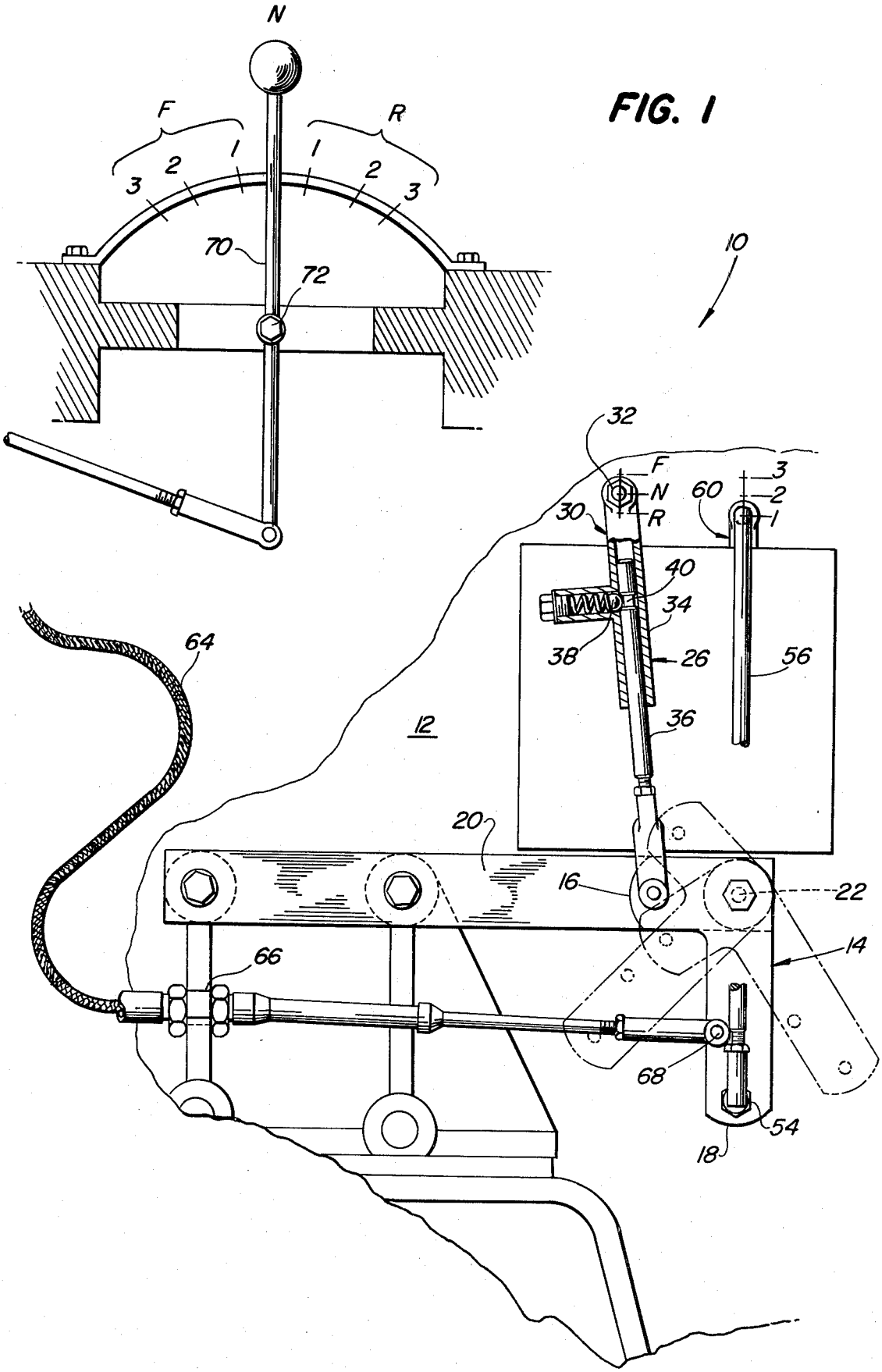
FIG. 1 is a schematic right side elevational view of the essential components of the transmission control linkage of the present invention with parts of the direction selector output link being shown in section.
Figure 2:
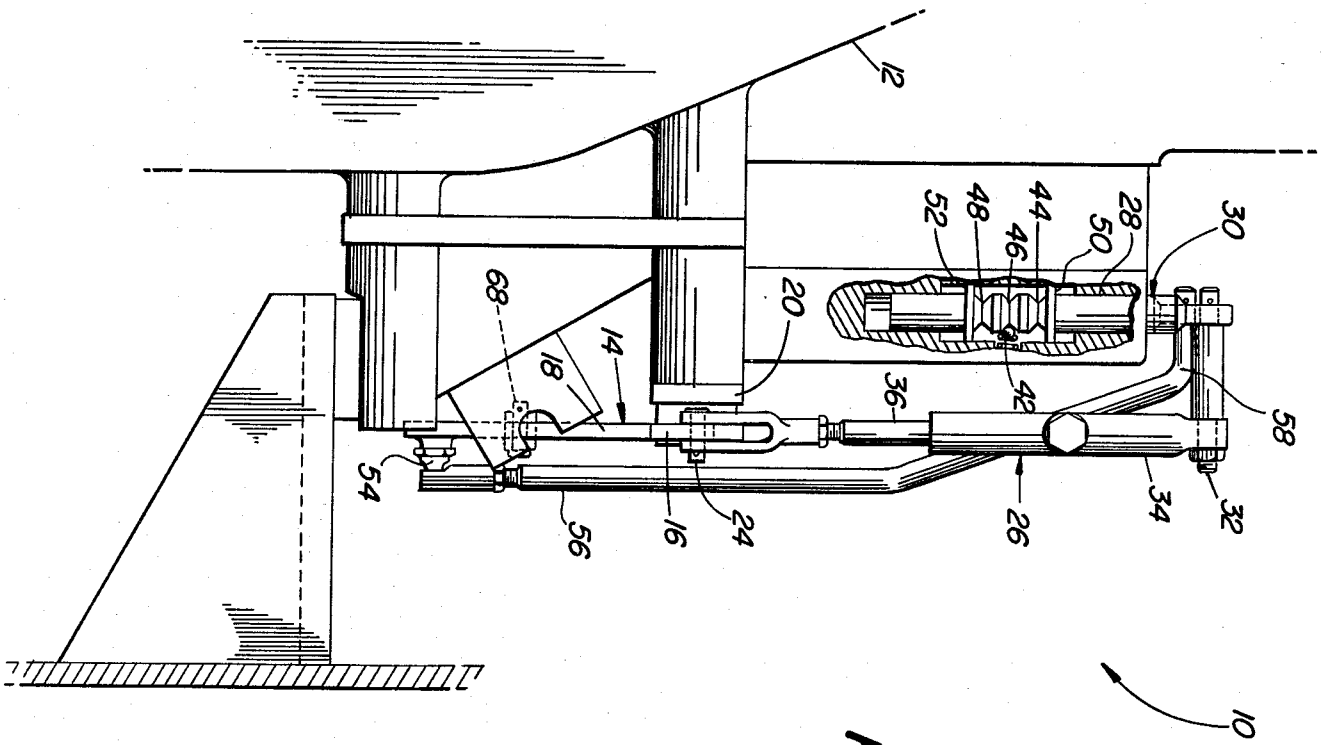
FIG. 2 is rear side elevational view of the control linkage shown in FIG. 1 with part of the direction selector valve being shown in section.

Referring now to the drawing, therein is shown a transmission shift control linkage, indicated in its entirety by the reference numeral 10, and a transmission 12. The linkage 10 includes an input link 14 having first and second legs 16 and 18, respectively, disposed at an angle of 90° relative to each other. The link 14 is pivotally mounted on a support bracket 20 for pivoting about a horizontal transverse axis defined by a pivot pin 22 extending through the link 14 at the juncture of the legs 16 and 18. When the link 14 is in a centered neutral position as illustrated, the first leg 16 extends horizontally and the second leg 18 extends vertically.

Pivotally connected to the link leg 16, by a pin 24, is the lower end of a first output link 26 having an upper end pivotally connected to the upper end of a spool 28 of a direction selector valve 30 by a pivot pin 32. The spool 28 is here shown in a neutral position N from which it may be shifted upwardly to a forward drive effecting position F or downwardly to a reverse drive effecting position R.

For a purpose described more fully hereinbelow, the first output link 26 is constructed to yieldably extend or collapse, from a normal condition shown in response to encountering a predetermined resistance to lengthwise movement thereof. Specifically, the link 26 includes an upper first section including an upper tubular portion 34 and a lower second section including a straight portion 36 formed of a rod reciprocably received in the portion 34 and normally held in place relative to the latter by a spring loaded detent ball 38 carried by the upper portion 34 and received in an annular groove 40 in the lower portion 36. It is here noted that the direction selector valve 30 includes a spring biased detent ball 42 located for yieldable reception in upper, intermediate and lower grooves 44, 46 and 48 respectively formed annularly in the spool 28 for respectively holding the spool 28 in its reverse, neutral and forward drive effecting positions. Located above the upper groove 44 is an annular flange or shoulder forming an upper stop 50 and located below the lower groove 48 is an annular flange or shoulder forming a lower stop 52. The spring biased detent ball 42 is designed to yieldably release the valve spool 28 when a predetermined force is exerted on the spool 28 by the first output link 26, such predetermined force being less than the predetermined resistance for effecting yieldable extension or collapse of the link 26 so that the link 26 will always be effective to shift the spool 28 among its neutral, forward and reverse drive effecting positions and will only extend or collapse upon the detent ball 42 coming into engagement with one or the other of the stops 50 and 52. For example, it has been found that the link 26 will operate properly if the detent ball 38 is designed to become released from the groove 40 under a load of 35 lbs. (15.88 kg.) to permit extension or collapse of the link 26 while the detent ball 42 is designed to become released from any one of the grooves 44, 46 and 48 of the spool 28 under a load of 25 lbs. (11.34 kg.).

Pivotally connected to a lower end of the link leg 18, by a ball and socket connector 54, is the lower end of a second output link 56 having an out-turned upper end 58 pivotally received in the upper end of a valve spool of a speed selector valve 60, here shown in a first speed effecting position from which it is shiftable upwardly to second and third speed effecting positions. It is noted that with the input link 14 in its illustrated neutral position, a line drawn through the opposite ends of the link 56 will intersect the rotational axis of the input link. Thus, it will be appreciated that movement of the input link 14 in opposite directions from its neutral position will effect movement of the second output link 56 and hence the the speed selector valve 60 in exactly the same way.

A push-pull cable 64 is reciprocably supported on the bracket 20, as at 66, for fore-and-aft movement and a pin 68 extends through a clevis fixed to the rear end of the cable and connects the clevis to the link leg 18 at a location below the pivot pin 22. The forward end of the cable 64 is connected in a similar manner to a lower end of a shift control lever 70 mounted, as at a pin 72 received in a middle location of the lever 70, for fore-and-aft pivotal movement, to opposite sides of a neutral position N, in which the lever is illustrated, to a series of three forward spaced positions $F_1$, $F_2$, and $F_3$ and a series of three rearward speed positions $R_1$, $R_2$ and $R_3$.

The operation of the invention is as follows. Assuming the linkage 10 to be in the condition illustrated, the shift control lever 70 will be in its neutral position and the input link 14 will be in a corresponding neutral position wherein it holds the direction control valve spool 28 in its neutral position and, consequently, the transmission 12 will be in neutral.

If it is then desired to place the transmission in its first speed forward driving condition, the operator needs only to push the shift control lever 70 forwardly to its $F_1$ position. The cable 64 will transmit this movement to the input link 14 to move the latter to its corresponding $F_1$ position. During this movement of the input link 14, the first output link 26 will move the direction selector valve spool 28 upwardly to its forward drive effecting position F. However, the movement of the input link 14 will only cause minimal displacement of the second output link 56 and due to tolerances at the connection joints of the link 56, no displacement of the spools of the speed selector valve 60 will occur.

Shifting of the transmission 12 to its second speed forward is accomplished by moving the shift control lever 70 further forwardly to its $F_2$ position. The cable 64 will transmit the movement to the input link 14 to move the latter to its corresponding $F_2$ position. Initial movement of the link 14 will be resisted due to the detent ball 42 being against the lower stop 50, however, once the resistance to movement results in a force sufficient for overcoming the force tending to hold the detent ball 38 in place, the link 26 will collapse. Upon collapse of the link 26, the input link 14 will continue to move and cause the second output link 56 to shift the speed selector valve spool to its second speed position $F_2$.

The shifting of the transmission 12 to its third speed position is accomplished in a manner similar to that for shifting it to its second speed position however the first output link 26 is now already collapsed so the detent ball does not initially resist movement of the input link 14.

Shifting of the transmission 12 to its first, second and third speed reverse conditions is accomplished in a manner similar to that described above for shifting the transmission to its corresponding forward drive speed conditions with the differences being that the shift control lever 70 is pulled rearwardly and the input link 14 rotates to exert a downward force tending to extend the first output link 26.

I claim:

1. In a control, for a hydraulically controlled transmission, including a direction selector valve shiftable in opposite directions from a neutral position respectively to forward and reverse drive-effecting positions, and a speed selector valve shiftable in a first direction from a first speed-effecting position to various serially arranged positions for effecting increasing speeds, an improved linkage for controlling the shifting of the direction and speed selector valves, comprising: an input link mounted for pivotal movement about a fixed axis among a centered neutral position and various forward and reverse speed positions respectively located in first and second directions from the last-named neutral position; a first output link pivotally interconnected between the input link and the direction selector valve; a second output link interconnected between the input link and the speed selector valve and located on the input link and the speed selector valve such that a line extending through the connections of the second output link with the input link and speed selector valve, when the input link is in its neutral position, intersects said axis; the respective connections of the first and second output links with the input link being such that respective lines joining the connections with the axis define an included angle of about 90°.

2. A powershift transmission control linkage in combination with a direction control valve having a first valve spool shiftable linearly from a centered neutral position to forward and reverse drive-effecting positions, and a speed control valve having a second valve spool disposed in parallel adjacent relationship to the first valve spool and shiftable linearly from a first speed position to various increasing speed positions located serially in a first direction from the first speed position, comprising: an input link mounted for pivotal movement about a fixed axis, extending crosswise to the paths of movement of the first and second valve spools, oppositely from a centered neutral position respectively to various forward and reverse speed positions; a first output link pivotally interconnected between the input link and one end of the first valve spool, a second output link interconnected between the input link and one end of the second valve spool such that said axis intersects a straight line passing through the connections of the second output link with the input link and the second valve spool; said first output link including first and second sections and yieldable connection means yieldable in response to a predetermined resistance for permitting the first and second sections to move unrestricted relative to each other thereby resulting in the respective connections of the first output link with the input link and the first valve spool to either move together or apart; and resistance means for acting on the first output link for yielding the yieldable connection means of the same when the input link is respectively rotated in opposite directions beyond its first speed forward and first speed reverse positions.

3. The combination defined in claim 2 wherein the valve spools are oriented for shifting in upward and downward directions; said axis being located below the valve spools and extending crosswise to the last-named directions; and the first and second output links respectively being connected to upper ends of the valve spool of the direction control valve and of the valve spool of the speed control valve.

4. The combination defined in claim 2 wherein the input link includes a first leg, which extends downwardly from the axis and is connected to the lower end of and aligned with the second output link when the input link is in its neutral position, and a second leg, which extends from the axis at a right angle to the first leg and is connected to the first output link.

5. The combination defined in claim 4 wherein the first and second sections of the first output link cooperate such that the first output link is telescopic; and said yieldable connection means including a groove in one of the sections, a biasing spring carried by the other of the sections and a detent ball located between the spring and the one of the sections so as to become yieldably seated in the groove when the input link is in its first speed forward and first speed reverse positions and any position therebetween.

6. In a control, for a hydraulically controlled transmission, including a direction selector valve shiftable in opposite directions from a neutral position respectively to forward and reverse drive-effecting positions, and a speed selector valve shiftable in a first direction from a first speed-effecting position to various serially arranged positions for effecting increasing speeds, an improved linkage for controlling the shifting of the direction and speed selector valves, comprising: an input link mounted for pivotal movement about a fixed axis among a centered neutral position and various forward and reverse speed positions respectively located in first and second directions from the last-named neutral position; said input link including first and second legs arranged to define an included angle of about 90° and joined at said axis; a first output link pivotally connected to the first leg of the input link and to the direction selector valve; a second output link having first and second locations thereof respectively connected to the second leg of the input link and to the speed selector valve such that said axis intersects a line extending through said first and second locations of the second output link when the input link is in its neutral position; said first output link including first and second sections; yieldable connection means connected between the first and second sections for permitting the sections to move relative to each other to lengthen or shorten the distance between the respective connections of the first output link with the input link and the direction selector valve upon the first output link meeting a predetermined resistance to movement; and resistance means for acting on the first output link for collapsing the same when the input link is respectively rotated in opposite directions beyond its first speed forward and first speed reverse positions.

7. The control defined in claim 1 wherein the first section of the first output link includes a straight tubular portion; and the second section of the first output link including a straight portion telescopically received in the tubular portion.

8. The control defined in claim 7 wherein the yieldable connection means between the first and second sections is defined by a spring loaded detent member carried by the tubular portion of the first section; and a detent recess located in the straight portion of the second section and having the detent member received therein when the first output link is in a normal condition.

* * * * *

UNITED STATES PATENT AND TRADEMARK OFFICE

CERTIFICATE OF CORRECTION

PATENT NO. : 4,297,909

DATED : 3 November 1981

INVENTOR(S) : Stephen K. Crouse

It is certified that error appears in the above—identified patent and that said Letters Patent is hereby corrected as shown below:

Column 6, line 28, delete "1" and insert -- 6 --.

Signed and Sealed this

*Twentieth* Day of *April 1982*

[SEAL]

*Attest:*

GERALD J. MOSSINGHOFF

*Attesting Officer*

*Commissioner of Patents and Trademarks*